US006866172B2

(12) United States Patent
Shackelford

(10) Patent No.: US 6,866,172 B2
(45) Date of Patent: Mar. 15, 2005

(54) PAINTER'S BELT-MOUNTED PAINT AND APPLICATOR HOLDER

(76) Inventor: George Shackelford, 38640 Bears Paw Dr., Murrietta, CA (US) 92572

( * ) Notice: Subject to any disclaimer, the term of this patent is extended or adjusted under 35 U.S.C. 154(b) by 113 days.

(21) Appl. No.: 10/405,785

(22) Filed: Apr. 1, 2003

(65) Prior Publication Data

US 2004/0195280 A1 Oct. 7, 2004

(51) Int. Cl.[7] ..... A45F 5/00

(52) U.S. Cl. ..... 224/148.4; 220/695; 220/697; 220/698; 220/736; 224/148.7; 224/673; 224/677; 224/679; 224/681

(58) Field of Search ..... 224/148.4, 148.7, 224/242, 673, 677, 679, 681; 220/23.9, 695–698, 735, 736

(56) References Cited

U.S. PATENT DOCUMENTS

| | | | | | |
|---|---|---|---|---|---|
| 1,466,084 | A | * | 8/1923 | Burrows | 220/495.02 |
| 2,893,030 | A | * | 7/1959 | Averna | 15/257.06 |
| 3,351,970 | A | * | 11/1967 | Engh | 224/578 |
| 4,122,973 | A | * | 10/1978 | Ahern | 220/675 |
| 4,746,042 | A | * | 5/1988 | King | 224/148.7 |
| 4,951,857 | A | * | 8/1990 | Carr | 224/242 |
| 5,072,868 | A | * | 12/1991 | Dickie et al. | 224/677 |
| 5,400,916 | A | * | 3/1995 | Weber | 220/697 |
| 5,489,051 | A | * | 2/1996 | Robinson | 224/148.4 |
| 5,549,216 | A | * | 8/1996 | Scholl | 220/695 |
| 5,695,098 | A | * | 12/1997 | King | 224/148.7 |
| 6,105,813 | A | * | 8/2000 | Abbey | 220/736 |
| 6,199,718 | B1 | * | 3/2001 | Ellis | 220/735 |
| 6,260,730 | B1 | * | 7/2001 | Fellman | 220/695 |
| 6,283,345 | B1 | * | 9/2001 | Butschat | 224/148.4 |
| 6,719,178 | B1 | * | 4/2004 | Taylor | 224/148.7 |
| 2002/0096525 | A1 | * | 7/2002 | Bertoldo et al. | 220/736 |

* cited by examiner

*Primary Examiner*—Gary E. Elkins
(74) *Attorney, Agent, or Firm*—Donald D. Mon

(57) ABSTRACT

A painter's belt-mounted paint and brush holder especially adapted for stability relative to the painter. It includes an open topped bucket with a rim that drains into the bucket cavity, and a stabilizer integral with the wall of the bucket that rises above the bucket with a substantial area that is drawn against the body of the painter.

14 Claims, 2 Drawing Sheets

PAINTER'S BELT-MOUNTED PAINT AND APPLICATOR HOLDER

FIELD OF THE INVENTION

A painter's belt-mounted paint and brush holder especially adapted for stability relative to the painter, decreasing retention of paint in undesired regions, optionally providing for ready exchange of colors without requiring cleanup of the holder, releasably holding the paint applicator, and ready closure of the holder.

BACKGROUND OF THE INVENTION

Painters working on large elevated areas customarily utilize long-handled tools which obtain their paint from trays or buckets placed on the floor or on a scaffold, or receive them through hoses. These are suitable and accepted techniques for painting large areas. Similarly, at or near ground or floor levels, these techniques are widely used.

On smaller jobs, and especially at higher elevations where access to a floor level supply is not convenient, the painter takes the bucket up the ladder with him and places it on a platform of some kind. This, of course limits the range of the painter's efforts and when he needs to work on a more distant area, he must dismount the ladder, move it and the bucket, and start again.

These procedures are useful for larger, mostly rather plain, painting. However, they make it needlessly difficult for paint jobs of more artistic nature. Examples of such more complicated jobs are treatment of areas in which patterns of various colors, texture, or composition are needed, such as walls to be textured to appear as a cloudy sky, or which are to have an image such as a face or other physical objects.

For these jobs, which generally are smaller in size but which require greater skill and artistry, it is known for painters to hang a pail of paint from a tool belt, with the pail dangling freely from the belt. The painter dips the applicator into the pail. The term "applicator" is used herein to denote a handled tool for applying paint, of which brushes and rollers are the most commonly encountered examples. It is used to denote both kinds.

While this bucket is available to the painter on the ladder, it calls for considerable care in its use because the applicator and pail are independently supported. When he climbs the ladder, he must attend to both the bucket and the applicator, holding the applicator with one hand, holding on to the ladder with the other, and caring for the dangling pail. This is not only clumsy and potentially dangerous, but distracting to an artist. This invention frees a hand which otherwise would be holding the applicator.

In the most ordinary usage, care must be exerted to control drip from both the applicator and from the bucket, especially from and around the groove in the rim of the bucket. Otherwise the bucket and its surroundings can become messy, and control over the color is reduced. The absence of bucket stability in the sense of a close coupling of the painter's body and the bucket is a considerable disadvantage.

Further, known buckets do not provide specific means for wiping the applicator while it is being removed from the bucket with paint to be applied to a surface. This can result in excessive paint on the applicator, and dripping of paint from the applicator.

Another disadvantage of the known art is the need either to use a large number of buckets, or to clean up a single bucket when a different color is to be applied. For large walls this is no problem. However, for small jobs, and especially for multi-color jobs, this is a serious disadvantage.

It is an object of this invention to provide a paint holder (frequently called a "bucket"), with an integral stabilizer which abuts the painter's body over a substantial area to establish the location of the bucket relative to the painter.

It is another object of this invention to provide a drain from the rim groove of the bucket which will drain paint from the groove back into the bucket.

It is yet another object of this invention to provide a shaped liner with an outer wall complementary to the rim groove and preferably also with some of the inner wall of the bucket. This liner is removable, so it can protect the bucket from undesired paint, and also so as to be removable and replaceable to present paints of different colors.

It is yet another object of this invention to provide a liner with multiple cavities so as to carry a plurality of colors in one liner.

It is still another object of this invention to provide in this holder an applicator mount arranged so the painter can easily store and access the applicator. When stored, it is in a position to drain into the bucket. When the painter climbs the ladder, or otherwise does not need the applicator, it is held in a proper place, with its handle held by the mount, and with the applicator portion below a covering lid through which the handle passes.

BRIEF DESCRIPTION OF THE INVENTION

A belt-mounted paint holder according to this invention includes a bucket portion having an outer wall and an inner wall, a bottom, and an upper rim to form a cavity. It further includes a stabilizer portion integral with the bucket portion which extends above the rim. It includes a substantial area shaped to contact a substantial area of the painter himself (through his clothing), with apertures to pass a tool belt in order to hold the holder against the painter (or his clothing).

The rim includes a peripheral groove and drain grooves which drain from the peripheral groove into the cavity. The bucket portion has a suitable dimension of depth to contain a desired amount of paint, and an open top to give proper access to the cavity. While the illustrated embodiments are in a shape generally regarded as a bucket the term "bucket" is intended also to include wider and shallower structures which more nearly resemble a tray.

According to an optional feature of the invention, an applicator mount is mounted to the stabilizer portion above the cavity so the applicator can be reliably held, bristles or roller down, in the cavity. Preferably it will formed as a removable clip.

A liner has an outer wall with a rim complementary to the peripheral rim of the bucket portion, into which it can fit, and which preferably includes drain grooves that drain into the liner. The liner fits in the cavity of the holder, and is removable from it. A lid has a depending flange adapted to close the bucket and a slot to pass the handle of an applicator with the head of the applicator in the bucket.

Optional ladder-like applicator wiper ribs are formed on the inner wall of the holder, and preferably also in the liner. They are shaped to remove excess paint from the applicator and drain it back into the bucket portion.

The above and other features of this invention will be fully understood from the following detailed description and the accompanying drawings, in which:

DETAILED DESCRIPTION OF THE INVENTION

Figure 1:
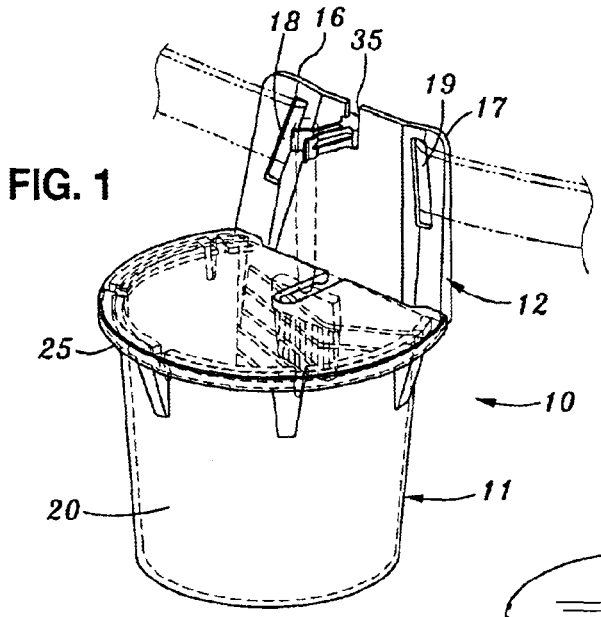
FIG. 1 is a perspective view of the presently-preferred embodiment of the invention, held on a user's belt.
Figure 3:
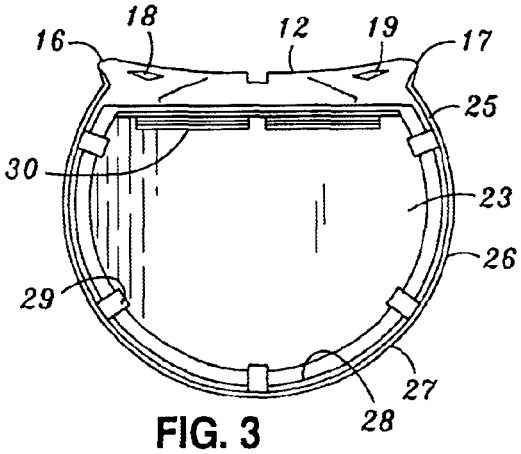
FIG. 3 is a top view of the bucket, taken at line 3—3 in FIG. 2.
Figure 4:
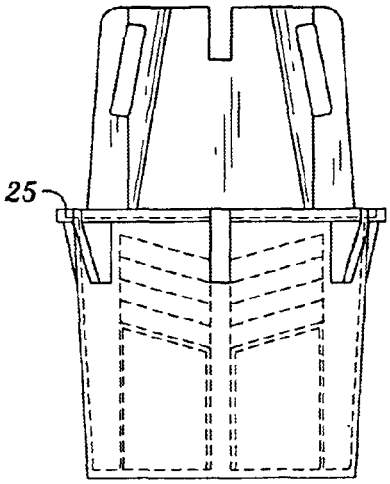
FIG. 4 is a front view of the bucket taken at line 4—4 in FIG. 2.
Figure 2:
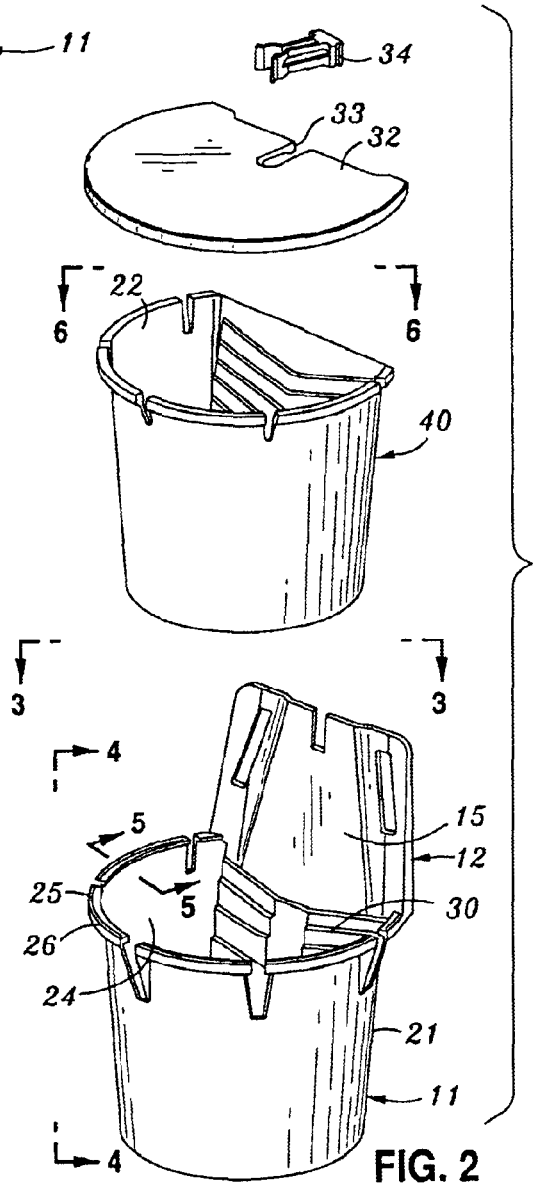
FIG. 2 is an exploded perspective view of the holder of FIG. 1.

A belt-mounted paint holder 10 according to this invention is shown in FIG. 1. Its principal components are a bucket portion 11 and a stabilizer portion 12. The holder is rigid, although it, and especially the stabilizer portion, may be stiffly flexible but still essentially shape-retaining.

The stabilizer portion has a plate-like surface 15 preferably with a pair of wings 16, 17, through which apertures 18 and 19 are formed to pass a belt 18. Fastening the belt will bring the stabilizer portion against the clothing of the painter and will pull the holder into a stabilizing condition, where it will move closely with the painter. The painter will always know precisely where the bucket portion, its contents and its surfaces, are located relative to himself.

Bucket portion 11 has a sidewall 20 with an outer surface 21 and an inner surface 22. A bottom 23, along with the sidewall form an internal cavity 24 which receives paint (not shown).

An upper rim 25 is formed at the top on the sidewall. It extends between intersections with the stabilizer portion. The rim includes an upwardly-facing groove 26 with an outer wall 27 and an inner wall 28, similar to the groove on a conventional paint cans. A plurality of drain grooves 29 pass through inner wall 28 and drain into the cavity. While the drain grooves will not reliably drain away all of the paint that may have entered groove 26, they will drain away enough so that a lid can be applied without substantial spill-over to the outside of the container, and the bucket portion topped somewhat without spilling.

As an optional feature, a ladder-like pattern of ribs 30 is formed on the inside wall of the bucket. The painter may use these to wipe excess paint from his applicator after dipping it in the paint. These ribs will preferably project into the cavity below the stabilizer portion when they will conveniently be contacted by the applicator and drain the paint back into the bucket portion.

Figure 5:
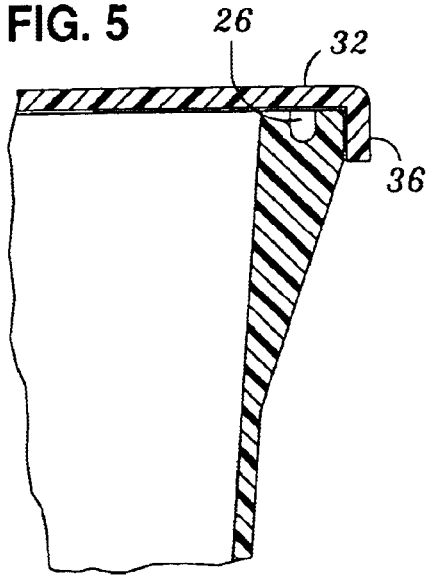
FIG. 5 is a fragmentary cross section taken at line 5—5 in FIG. 2, also showing the lid closing the bucket.

A lid 32 may be separable from the bucket (and preferably will be) or instead may be attached to it by a hinge (not shown). The hinge may be a self-hinge when the bucket portion and lid are made of a suitably flexible organic plastic such as polyethylene, sufficiently thin. The lid has a slot 33 from its edge next to the stabilizer portion to pass the handle of applicator. A mount 34, referred herein as a "clip" is separately mounted to the stabilizer portion by being passed through a slot 35 in the stabilizer portion. The lid has a depending flange 36 (FIG. 5) that surrounds the rim when applied. It abuts the stabilizer portion to close the bucket. The clip may be provided as an integral part of the support, but preferably will be removable for storage when not needed.

Figure 6:
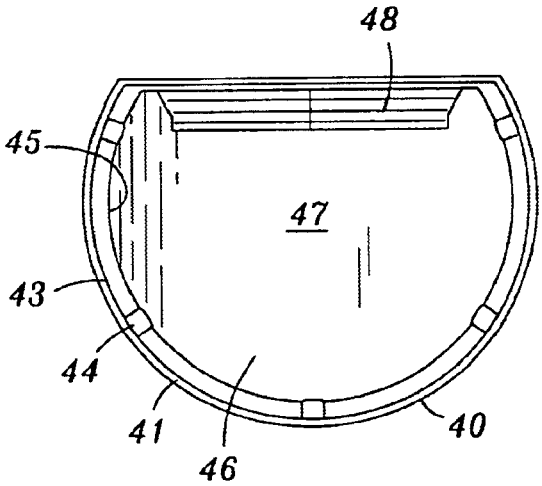
FIG. 6 is a top view of a liner taken at line 6—6 in FIG. 2.
Figure 9:
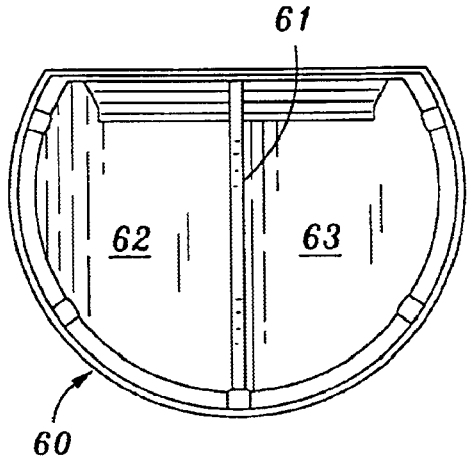
FIG. 9 is a top view of a modified liner.
Figure 8:
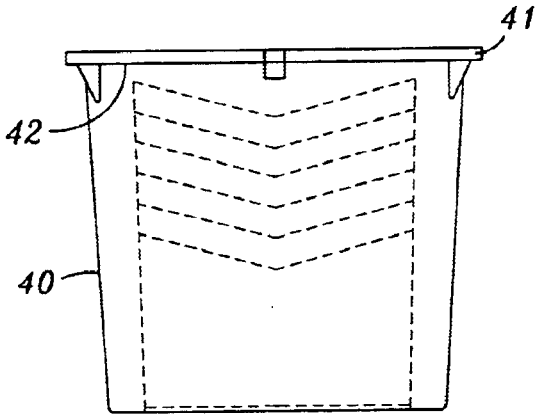
FIG. 8 is a front view of the liner of FIG. 6.

A liner 40 is shown in detail in FIGS. 6, 8 and 9. This liner is intended to fit into the cavity of the bucket portion, preferably in contact with the inner wall of the bucket portion, and with complementary inside surfaces so as to provide the same advantages as the bucket portion itself. It may be a semi-rigid structure preformed with most of the complementary shapes, or be made as a more flexible structure which is flexible enough to conform and become complementary to the bucket portion.

One part of the liner which must be relatively rigid is an upper rim 41 with lower face 42 that fit over the top of the bucket groove. This will protect the upper rim of the bucket portion from paint from the liner. In turn, the liner's rim also includes a peripheral groove 43 with drain grooves 44 that drain back into the liner.

The liner is completed with a peripheral sidewall 45 depending from the rim, and a bottom 46. These form a cavity 47 in the liner.

As stated above, the liner may have a pattern of wiper ribs 48 formed in it, or if the liner is flexible enough, they will be formed by contact of the liner with the ribs of the bucket portion.

Figure 7:
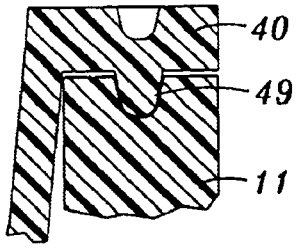
FIG. 7 is a fragmentary cross section taken at line 5—5 in FIG. 1 also showing a liner in the bucket.

An optional tongue 49 (FIG. 7) on the bottom of the liner's rib can extend into groove 26 on the bucket.

The bucket portion can be used without a liner. Then it can enjoy the convenience and reliability of the stabilized constructions but without the convenience of the liner. The liner may be used, always or occasionally as desired. In jobs requiring multiple colors, liners with paints of different color can readily be removed and replaced. This can be a significant advantage, especially for jobs with substantial artistry.

If desired, a bucket portion 60 (or a liner), (FIG. 9) may be divided into more than one cavity by a rib 61 to form cavities 62, 63 so that more than one color can be carried at a time.

While the central part of the illustrated stabilizer portion is shown against the user with the belt pressing against the outside, the reversal is also within the meaning of the statement that the stabilizer portion is brought against the wearer. In that event, the belt itself would be against the user at the center, and the outer portions of the stabilizer portion are against him. Both arrangements are within the intended scope of the claims.

This invention thereby provides a convenient, stable and reliable and safe means for a painter to carry his paint and applicators.

This invention is not to be limited by the embodiments shown in the drawings and described in the description, which are given by way of example and not of limitation, but only in accordance with the scope of the appended claims.

I claim:

1. A painter's belt-mounted paint holder comprising:

a bucket portion having a peripheral wall having an upper end, an inner surface and an outer surface, and a bottom forming an open-topped cavity, a peripheral rim extending around said upper end, an upwardly facing groove in said rim extending around said rim bounded by an outer wall and an inner wall, and drain grooves through said inner wall draining said upwardly facing groove into said cavity; and a stabilizer portion integral with a portion of the peripheral wall of the bucket portion, intersected by said peripheral rim, said stabilizer portion rising above said bucket portion and having a substantial area so disposed and arranged as to be drawn against a painter, said stabilizer portion including apertures to pass a belt to hold the stabilizer portion against the painter.

2. A paint holder according to claim 1 in which said inner surface includes a plurality of ribs against which the painter can wipe an applicator.

3. A paint holder according to claim 1 in which a lid is provided to engage to said rim to close said bucket portion.

4. A paint holder according to claim 1 in which a clip is held to said stabilizer portion overhanging said bucket portion releasably to hold the handle of an applicator with its applicator portion depending into said bucket.

5. A paint holder according to claim 3 in which a clip is held to said stabilizer portion overhanging said bucket portion releasably to hold the handle of an applicator with its applicator portion depending into said bucket.

6. A paint holder according to claim 5 in which said lid has a slot therethrough to pass said handle.

7. A paint holder according to claim 1 in which said cavity is provided with an internal rib to form a plurality of lesser cavities to accommodate a plurality of colors.

8. In combination:

a paint holder according to claim 1; and a liner adapted to fit into the cavity in said bucket portion, said liner having a peripheral side wall, a bottom, and a peripheral rim, whereby to form a paint-receiving cavity, said rim including an upper peripheral groove with an inner wall, an outer wall, drain grooves through said inner wall draining into the liner cavity and a peripheral lower tongue proportioned to fit into the upwardly-facing groove in the bucket portion.

9. A combination according to claim 8 in which said outer wall of the liner is shaped complementary to the inner surface of the bucket portion.

10. A combination according to claim 8 in which the side wall of the liner is sufficiently flexible as to form internal shapes geometrically similar to those of the inside surface of the bucket portion.

11. A combination according to claim 9 in which said outside wall of the liner includes ribs against which a brush may be wiped.

12. A combination according to claim 8 in which a clip is mounted to said stabilizer portion releasably to hold the handle of an applicator.

13. A combination according to claim 12 in which a lid is provided to close said upper end of said cavity, said lid including a depending flange to close said cavity around said rim, said lid having a slot therethrough to pass the handle of an applicator.

14. A liner for separately confining paint inside the bucket portion of a paint holder comprising a peripheral side wall, a bottom, and a peripheral rim, whereby to form a paint-receiving cavity, said rim including an upper peripheral groove with an inner wall, an outer wall, drain grooves through said inner wall draining into the liner cavity, and a plurality of wiper ribs in said peripheral wall.

* * * * *